United States Patent [19]

Sipkema

[11] 3,994,611

[45] Nov. 30, 1976

[54] DEVICE FOR APPLYING A ROAD MARKING LINE OR THE LIKE

[75] Inventor: Jan Sjouke Sipkema, Vught, Netherlands

[73] Assignee: Wegenbouwmaatschappij J. Heijmans B.V., Rosmalen, Netherlands

[22] Filed: July 24, 1975

[21] Appl. No.: 598,773

[30] Foreign Application Priority Data

July 30, 1974 Netherlands ..... 7410213

[52] U.S. Cl. ..... 404/94; 404/98

[51] Int. Cl.[2] ..... E01C 23/16

[58] Field of Search ..... 404/93, 105, 108, 94, 404/110, 98; 401/126; 118/242

[56] References Cited

UNITED STATES PATENTS

| | | | |
|---|---|---|---|
| 1,744,613 | 1/1930 | Coulter | 404/105 |
| 1,923,632 | 8/1933 | MacRae | 404/94 |
| 2,186,081 | 1/1940 | Slavin | 404/110 |
| 2,403,820 | 7/1946 | Miller | 404/110 |
| 2,940,105 | 6/1960 | Woellwarth | 404/94 X |
| 3,070,822 | 1/1963 | Lipkins | 404/94 X |
| 3,208,360 | 9/1965 | Hayes | 404/110 |
| 3,373,669 | 3/1968 | Schmitz | 404/110 |

*Primary Examiner*—Nile C. Byers
*Attorney, Agent, or Firm*—Guy A. Greenawalt

[57] ABSTRACT

An apparatus for applying a longitudinal line or strip of marking material on a roadway which employs a fluid marking material and which provides spaced transverse strip areas of increased depth, the apparatus comprising a supply hopper for the marking material which opens at the rear to allow material to flow onto the roadway surface between spaced side edge defining members and a rear end plate member which is mounted for intermittent vertical reciprocation so as to provide for deposit of cross strips of the marking material which are of different depth or height. The end plate is also mounted for reciprocation longitudinally of the apparatus so as to push the marking material back into the hopper at the end of each section of the longitudinal strip. In a modified form of the apparatus illustrated a bottom plate is disposed between the vertically reciprocal end plate which is mounted for reciprocation in a vertical path so as to push back into the supply hopper the marking material which is contacting the roadway surface when the end of a section of the marking strip is reached.

9 Claims, 6 Drawing Figures

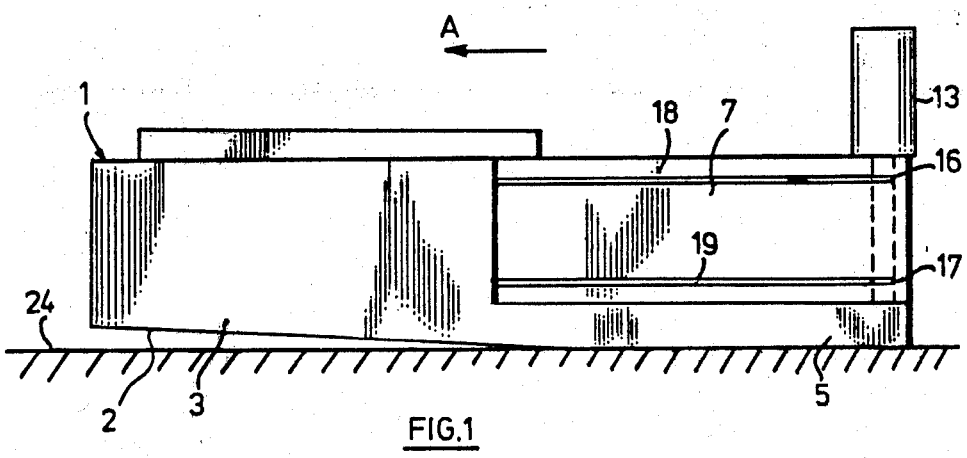
FIG.1
FIG.2
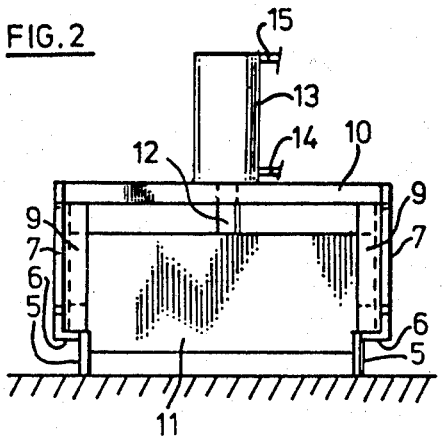
FIG.3
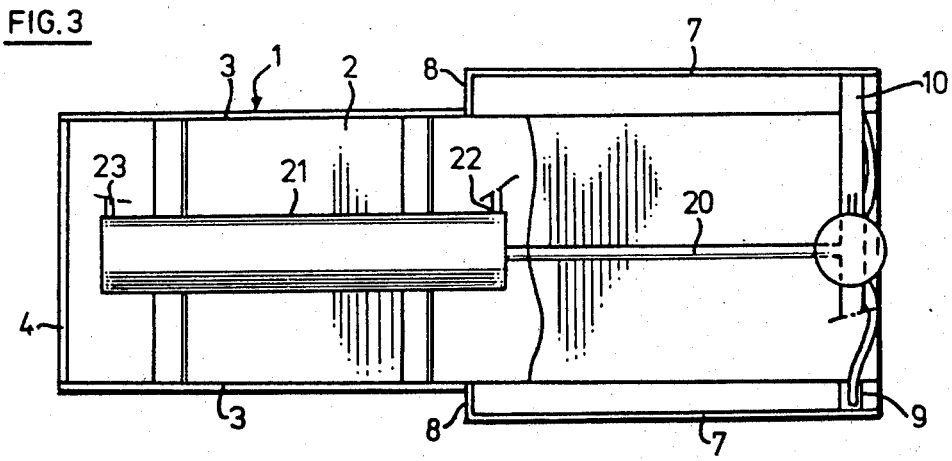

DEVICE FOR APPLYING A ROAD MARKING LINE OR THE LIKE

The invention relates to a device for applying a road marking line or the like to a road surface or the like, the height of which varies viewed in the direction of length of the line, said device comprising a hopper from which the marking material can be applied to the road surface and a closing flap adapted to be moved up and down.

Proposals have been made to provide on a road surface or the like marking strips having, viewed in the direction of length of the strip, a profile varying in height in order to improve the visibility of such marking strips, especially in rainy weather.

One of the problems involved, particularly if it is desired to make such road marking strips which are interrupted at regular intervals, is the difficulty of obtaining a regular shape of the end of the strip. If only the supply of material to the closing flap movable in a vertical sense is shut off and if the machine is moved on whilst moving the closing flap up and down until all material still located in front of the closing flap has left, the end of the strip will have an irregular, smeared-out form, whilst in addition the terminus of the marking strip cannot be accurately defined, which is particularly advantageous in forming interrupted strips, when the strips and the voids between them should have definite lengths.

The invention has for its object to provide a device of the kind set forth by means of which the marking strip made can be shaped in a regular form at a desired point of the road surface or the like.

According to the invention this can be achieved by connecting the closing flap with the aid of two determining, in operation, by their lower ends the width of the strip on the road surface or the like with a holder provided with a bottom, there being provided means for returning the marking material located in front of the vertically movable closing flap and between the arms, viewed in the direction of movement in operation back to the hopper.

Such a device permits of providing at any desired spot a regularly shaped, sharply defined end of a road marking strip.

The invention will be described more fully hereinafter with reference to a few embodiments of a device in accordance with the invention shown schematically in the accompanying drawings.

FIG. 1 is a schematic side elevational view of a first embodiment of a device in accordance with the invention.

FIG. 2 is an end elevational view of the device of FIG. 1.

FIG. 3 is a plan view of the device of FIG. 1.

Figure 4:
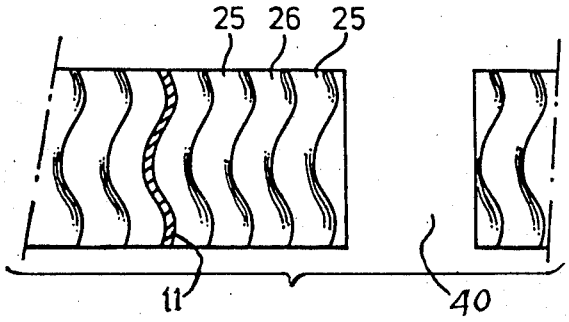
FIG. 4 is a plan view of profiled, interrupted marking strip made by means of the device in accordance with the invention.

The device shown in FIGS. 1 to 3 comprises a hopper 1 having a bottom sheet 2, upright sidewalls 3 and front wall 4.

At the rear ends of the sidewalls 3 arms 5 are arranged in line wth the sidewalls 3. The upper edges of the arms 5 engage the horizontal, rectangularly bent-over ends of side plates 7. The front ends 8 of the side plates are bent over at right angles to the inner side and secured to the side walls 3. The horizontally bent-over ends 6 of the side plates 7 support the lower ends of vertical, channel-section beams 9, the top ends of which are interconnected by a horizontal beam 10. The open sides of the channel-section beams 9 are facing one another and the channel-section beams 9 accommodate the ends of a vertical closing flap 11 having a corrugated sectional shape, the lower part of which just fits between the arms 5.

The top side of the flap 11 is secured to a piston rod 12 of a setting cylinder 13 fastened to the top side of the beam 10, to which fluid can be fed through conduits 14 and 15. It will be obvious that the closing flap can be vertically moved up and down with the aid of the setting cylinder 13 by supplying and draining fluid through the conduits 14 and 15 on either side of a piston secured to the piston rod 12 and arranged inside the setting cylinder 13.

On the distal sides of the channel-section beams 9 there are secured one above the other two cams 16 and 17, located in horizontal slots 18 and 19 respectively in the side plates 7.

To the beam 10 is furthermore secured the end of a horizontal piston rod 20, the other end of which is secured to a piston located in a setting cylinder 21. Fluid can be fed to and withdrawn from this setting cylinder through conduits 22 and 23 connected with the setting cylinder 21.

In operation the device can be moved on in the direction of the arrow A along a road surface 24 or the like, where a marking strip or the like has to be made. To this end the device may be coupled with a vehicle provided, for example, with means for heating the road marking material, usually formed by a white, resinous substance and with means for feeding this road marking material to the hopper 1.

Figure 5:
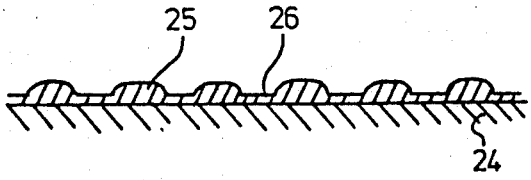
FIG. 5 is a sectional view of the profile of FIG. 4, an interruption of the marking strip being illustrated.

From the schematically shown embodiment it will be apparent that the bottom 2 is preferably inclined slightly rearwardly and downwardly so that the road marking material fed into the hopper 1 will flow towards the rear side of the hopper and will be deposited in a layer on the road surface 24 or the like between the arms 5 determining the width of the strip and sliding along the surface in operation. During the travel of the device the closing flap 11 will be intermittently moved up and down by means of the setting cylinder 13 between a lowermost position in which the lower end of the flap 11 is located at a given, small height above the road surface 24 or the like and a topmost position varying with the height of the elevations of the desired road marking strip. Normally the road marking material accumulates in front of the flap 11 and during the reciprocatory movement of the flap 11 a road marking strip or the like is obtained, the height of which, viewed in the direction of length of the strip varies as is illustrated in FIGS. 4 and 5. Thus a road marking strip is obtained consisting of ridges 25 joining one another by thinner portions 26.

When a strip has to be terminated, the flap 11 can be adjusted by the setting cylinder 13 with the aid of an appropriate mechanism so that the lower side of the flap 11 comes into contact with the road surface. Subsequently the setting cylinder 21 is actuated in order to displace the interconnected guide members for the flap in the channel-section beams 9 with respect to the side plates 7 in the direction of the arrow A into a position in which the bottom side of the flap is in contact with the corrugated rear end of the bottom plate 3. Thus all material located in front of the flap 11 is slid back into the holder 1 so that the end of the road marking strip will have an end of regular shape.

The supply and withdrawal of fluid to and from the setting cylinder 13 for producing the reciprocatory movement of the flap 11 are preferably regulated by means of a control-member governed by a micro-switch, which is actuated in accordance with the distance covered by the device so that the ridges are formed at regular intervals. It is efficient to provide, for example, a wheel of the vehicle moving the device with a crown of pins or the like, by means of which the micro-switch is actuated at equal intervals. In order to form a regularly interrupted strip micro-switches or similar control-members may be provided in a similar manner, by means of which the setting cylinder 13 pushes the flap 11 substantially completely downwards, after which the setting cylinder 21 draws the flap 11 against the end of the bottom plate 2, the flap 11 being returned to the position shown in FIGS. 1 to 3 with the aid of the setting cylinder 21 after a given distance has been covered, after which the flap 11 is again moved up and down by the setting cylinder 13 in the manner described above to form the ridge pattern.

As a matter of course, many variants of the embodiment described above can be designed for returning the marking material located between the arms 5 in front of the flap 11 back to the hopper. For example, the flap 11 may occupy a given position whilst the hopper may be displaceable towards the flap. As a further alternative, a further bottom plate may be arranged on the bottom plate, which can be slid between the arms 5 towards the closing flap 11 and back.

Figure 6:
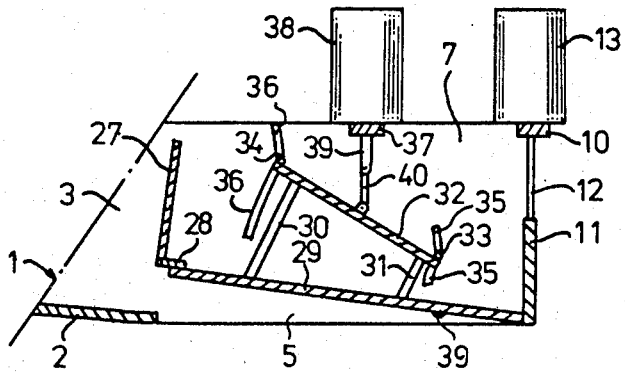
FIG. 6 is a schematical sectional view of part of a second embodiment of a device in accordance with the invention.

A further embodiment of the device in accordance with the invention is shown schematically in FIG. 6. Component parts corresponding with those described for the first embodiment are designated by the same reference numerals.

In this embodiment the flap 11 is not displaceable in a horizontal direction and the beam 10 is stationarily arranged between the side plates 7.

At the level of the rear end of the bottom plate 2, between the side plates 7, a second closing flap 27 is arranged to the lower end of which is secured a strip 28 extending rearwardly at right angles to the closing flap 27. To the lower side of the strip 28 is fastened the front end of a plate 29 fitting between the arms 5 so that the strip 28 slightly projects beyond the front end of the plate 29.

Near the sides of the plate 29 upright rods 30 and 31 are arranged, the top ends of which are secured to a plate 32. The plate 32 is provided with pins 33 and 34, located in elongated holes 35 and 36 respectively in the side plates.

Between the side plates 7 a beam 37 is arranged, to which a setting cylinder 38 is secured. The lower end of a piston rod 39 secured to a piston located in the setting cylinder 38 is pivoted to the top end of a coupling rod 40, the lower end of which is pivoted to the plate 32.

In the position shown the rear end of the plate is located on the road surface or the like and at the front side of the flap 11. As will be apparent from the Figure, the pins 33 and 34 are located near sharp bends in the elongated holes 35 and 36, from which bends the elongated holes extend upwards along slightly inclined lines in a direction away from the flap 11. It will be apparent that, when the plate 29 is further moved upwards by means of the setting cylinder 38, the rear end of the plate 29 will also be lifted from the road surface or the like and also from the flap 11. In this position the flap or slide 11 can be moved up and down in the manner described above with the aid of the setting cylinder 13 in order to form ridges. The feeding rate of material to the control-side 11 may, in addition, be varied by changing the height of the plate 29.

In order to form the end of a strip, the plate 29 will be moved down by means of the setting cylinder 38 out of the position normally occupied by the plate 29, the plate 29 then passing beyond the position shown in FIG. 6. When the plate 29 is pushed further down by means of the setting cylinder 38 out of the position shown in FIG. 6, it will turn about one end of the plate engaging the flap 11, for which purpose the portions of the elongated holes 35 and 36 extending downwards away from the bends have a curved shape matching said pivotal movement. It will be obvious that when the plate 29 is turned downwards out of the position shown in FIG. 6 the road marking material located in front of the flap 11 and beneath the plate 29 between the arms 5 is pushed back into the hopper. At the end of the downward movement of the plate 29 the end of the strip 28 projecting in front of the plate 29 will engage the rear edge of the bottom plate 2 and together with the flap 27 it will shut the hopper 1 so that during the further movement of the device no material will any longer flow out of the hopper 1 to between the arms 5.

Instead of causing the plate 29 to perform a pivotal movement, it may be moved vertically up and down in order to remove the material located between the arms 5 in front of the flap 11.

FIG. 6 shows furthermore a thickened part 39 on the bottom plate 29, which may be rectilinear in contrast to the corrugated flap 11, so that an interrupted marking strip can be made as shown in FIG. 4. As a matter of course, the thickness and the sharpness of the thickened part 39 have to be such that the closing effect described above and the reversing effect of the bottom plate 29 in returning the road marking material to the hopper 1 are obtained on the left-hand side of the line 39. In this manner a rectilinear end of the corrugated marking strip is obtained and these rectilinear ends are required for the axis mark of the road.

Such a thickened part 39 also serves to start again with a straight line as indicated in the left-hand part of FIG. 4 so that an open space 40 is left.

It is, of course, also possible to obtain a rectilinear end of the marking strip, for example, by means of a second flap 11, which is actuated by means of an independent cylinder, the operation of which depends upon, for example, the movement of the cylinder 21 or the cylinder 38.

I claim:

1. An apparatus for applying a marking strip on a road surface or similar area which strip has a variable height when viewed in the direction of the length of the strip, said apparatus comprising means forming a hopper for holding a quantity of liquid marking material and adapted to be advanced over the road, said hopper having a trailing end wall with an opening through which the marking material will flow, a pair of laterally spaced arm members extending from the trailing end of said hopper and having lateral spacing according to the width of marking strip desired, said arm members being positioned with bottom edges riding on the road surface so as to confine laterally the marking material which is received between said arm members through the opening in said hopper end wall, a flap member in the form of a panel positioned between the trailing ends of said arm, members, means mounting said flap member for vertical movement, said flap member having a bottom edge which in one vertical position contacts said road surface so as to terminate the application of the marking material, and means controlling the vertical movement of said flap member so as to vary the elevation of the bottom edge thereof above said road surface as said apparatus is advanced over said surface, thereby to vary the height of the marking material in the strip applied to the road surface.

2. An apparatus as set forth in claim 1 wherein said means mounting said flap member comprises laterally spaced, vertically extending guide members, which guide members are connected to form a mounting frame extending between said arm members in which said flap member is supported for vertical movement, said arm members having associated upstanding side wall forming members, and means cooperating with said flap mounting frame and said side wall forming members enabling said flap mounting frame to be moved between an extended position at the ends of said arm members and a retracted position adjacent said trailing end wall of said hopper where said flap member will close the opening in said end wall and cut off the supply of marking material for application to the road surface.

3. An apparatus as set forth in claim 1 wherein said means controlling the vertical movement of said flap member comprises a fluid setting cylinder having a piston connected to said flap member and a control means which will operate said setting cylinder to raise and lower said flap member while said apparatus is advanced over said road surface so as to provide intermittently transversely extending ridges in said marking strip.

4. An apparatus as set forth in claim 3 wherein said flap member has a corrugated contour resulting in wave like form for the transverse ridges in said marking strip.

5. An apparatus as set forth in claim 1 wherein said means controlling the vertical movement of said flap member includes a setting cylinder having a piston connected to said flap member and a control means for said cylinder which is responsive to advancing movement of said apparatus so as to raise and lower said flap member variable distances as said apparatus advances along said road surface whereby spaced ridges are formed in the marking material which extend transversely of the marking strip and which have increasing and decreasing height.

6. An apparatus as set forth in claim 1 wherein said arm members have associated means for forcing back into the hopper marking material which has been fed from said hopper into the applying area between said arm members when said flap member is positioned with the bottom edge thereof contacting said road surface so as to interrupt the application of the marking material.

7. An apparatus as set forth in claim 6 wherein said means for forcing said marking material back into said hopper includes means for closing the opening in said hopper end wall so as to confine the material to the hopper.

8. An apparatus as set forth in claim 6 wherein said means for forcing said marking material back into said hopper includes means forming a frame for supporting said flap member, side wall formations extending upwardly of said arm members, which side wall formations have associated guide tracks, means on said flap supporting frame riding on said guide tracks, and a setting cylinder having a piston connected to said frame and operative to move said frame along said guide tracks to a position adjacent said opening in said hopper end wall with said flap member in position to close said opening.

9. An apparatus as set forth in claim 6 wherein said means for forcing said marking material into said hopper comprises a plate member movably mounted above the area between said arm members and between said flap member and the trailing end wall of said hopper and means for moving said plate member downwardly while said flap member is positioned with its bottom edge contacting said road surface so as to force the material in said area back into said hopper.

* * * * *